US006745515B1

(12) United States Patent
Chen

(10) Patent No.: US 6,745,515 B1
(45) Date of Patent: Jun. 8, 2004

(54) EMERGENCY ESCAPE DOOR

(76) Inventor: Chi Sheng Chen, P.O. Box 63-298, Taichung (TW), 406

( * ) Notice: Subject to any disclaimer, the term of this patent is extended or adjusted under 35 U.S.C. 154(b) by 13 days.

(21) Appl. No.: 10/330,865

(22) Filed: Dec. 24, 2002

(51) Int. Cl.[7] ..... E05D 15/48; E06B 7/28; E05B 65/04

(52) U.S. Cl. ..... 49/169; 49/62; 49/501; 160/180

(58) Field of Search ..... 49/169, 501, 170, 49/504, 62, 61, 63; 160/180

(56) References Cited

U.S. PATENT DOCUMENTS 712,449 A * 10/1902 Young ..... 49/169
1,186,565 A 6/1916 Fogg
1,581,776 A * 4/1926 Altschul ..... 49/169
1,820,127 A * 8/1931 Elkington ..... 49/213
1,859,974 A * 5/1932 Kroenke ..... 160/97
2,188,123 A * 1/1940 Patterson et al. ..... 49/400
3,289,556 A * 12/1966 Russell ..... 404/25
4,480,407 A 11/1984 Needham et al. ..... 49/168
5,365,706 A * 11/1994 Elsenpeter et al. ..... 52/204.1
5,850,710 A 12/1998 Brock ..... 49/141
6,185,871 B1 * 2/2001 Wang ..... 49/501

* cited by examiner

*Primary Examiner*—Hugh B. Thompson, II

(57) ABSTRACT

An emergency escape door device includes a primary door panel having an entrance formed in an inner peripheral surface inclined between a greater peripheral side contour a smaller peripheral side contour, and an auxiliary door panel pivotally secured to the primary door panel to selectively enclose the entrance of the primary door panel and having an inclined outer peripheral surface to mate with the inclined inner peripheral surface of the primary door panel. The auxiliary door panel may be disengaged from the primary door panel in such as an earthquake.

4 Claims, 8 Drawing Sheets

EMERGENCY ESCAPE DOOR

BACKGROUND OF THE INVENTION

1. Field of the Invention

The present invention relates to an emergency escape door assembly, and more particularly to an emergency escape door assembly having an automatically disengageable or separable auxiliary door panel.

2. Description of the Prior Art

Typical emergency escape door assemblies or pet door assemblies comprise an auxiliary door panel pivotally attached to a primary door-panel. Two of the typical emergency escape door assemblies are disclosed in U.S. Pat. No. 1,186,565 to Fogg, and U.S. Pat. No. 4,480,407 to Needham et al.

However, the auxiliary door panel includes a flat and lateral outer peripheral surface engaged with a cooperating flat and lateral inner peripheral surface of the primary door panel, such that the auxiliary door panel may not be easily disengaged or detached from the primary door panel, particularly when the door panels are jammed during such as an earthquake or the other accidents.

U.S. Pat. No. 5,8,50,710 to Brock discloses another emergency escape window including a jamb pivotally movable relative to a frame. The frame and the jamb members are tapered to prevent binding during opening and closing. However, when buildings or walls are collapsed, the force may mostly applied onto the upper portion of the door panels, such that the escape window of Brock may not be automatically disengaged or separated from the primary door panel or door frame. The escape window of Brock may only be distorted and jammed in the primary door panel.

The present invention has arisen to mitigate and/or obviate the afore-described disadvantages of the conventional emergency escape doors.

SUMMARY OF THE INVENTION

The primary objective of the present invention is to provide an emergency escape door assembly including an auxiliary door panel arranged to be automatically disengaged or separated from the primary door panel, in such as an earthquake or the other accidents.

In accordance with one aspect of the invention, there is provided an emergency escape door assembly comprising a primary door panel including an entrance formed therein, and including an inclined inner peripheral surface formed therein to define the entrance thereof the primary door panel including a first side having a greater opening formed therein and defined by a greater peripheral contour, and a second side having a smaller opening formed therein and defined by a smaller peripheral contour, the inclined inner peripheral surface of the primary door panel being inclined between the greater peripheral contour of the first side and the smaller peripheral contour of the second side thereof, and an auxiliary door panel pivotally secured to the primary door panel, and to selectively enclose the entrance of the primary door panel, the auxiliary door panel including an inclined outer peripheral surface formed therein for mating with the inclined inner peripheral surface of the primary door panel, and the auxiliary door panel including a first side having a greater outer peripheral contour, and a second side having a smaller outer peripheral contour provided therein, and the inclined outer peripheral surface of the auxiliary door panel being inclined between the smaller outer peripheral contour of the second side and the greater outer peripheral contour of the first side thereof. The inclined outer peripheral surface of the auxiliary door panel is slidable relative to the inclined inner peripheral surface of the primary door panel to allow the auxiliary door panel to be automatically disengaged from the primary door panel when either side of the primary door panel is subjected with a compressing force, particularly in an earthquake or the other accidents.

The inclined outer peripheral surface of the auxiliary door panel includes a concave shape, and the inclined inner peripheral surface of the primary door panel is convex to mate with the concave and inclined outer peripheral surface of the auxiliary door panel.

Alternatively, the inclined outer peripheral surface of the auxiliary door panel may include a convex shape, and the inclined inner peripheral surface of the primary door panel may be concave to mate with the convex and inclined outer peripheral surface of the auxiliary door panel.

Further alternatively, the inclined outer peripheral surface of the auxiliary door panel includes at least one concave portion and at least one convex portion, and the inclined inner peripheral surface of the primary door panel may include convex portion and at least one concave portion to mate with the concave portion and the convex portion of the inclined outer peripheral surface of the auxiliary door panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
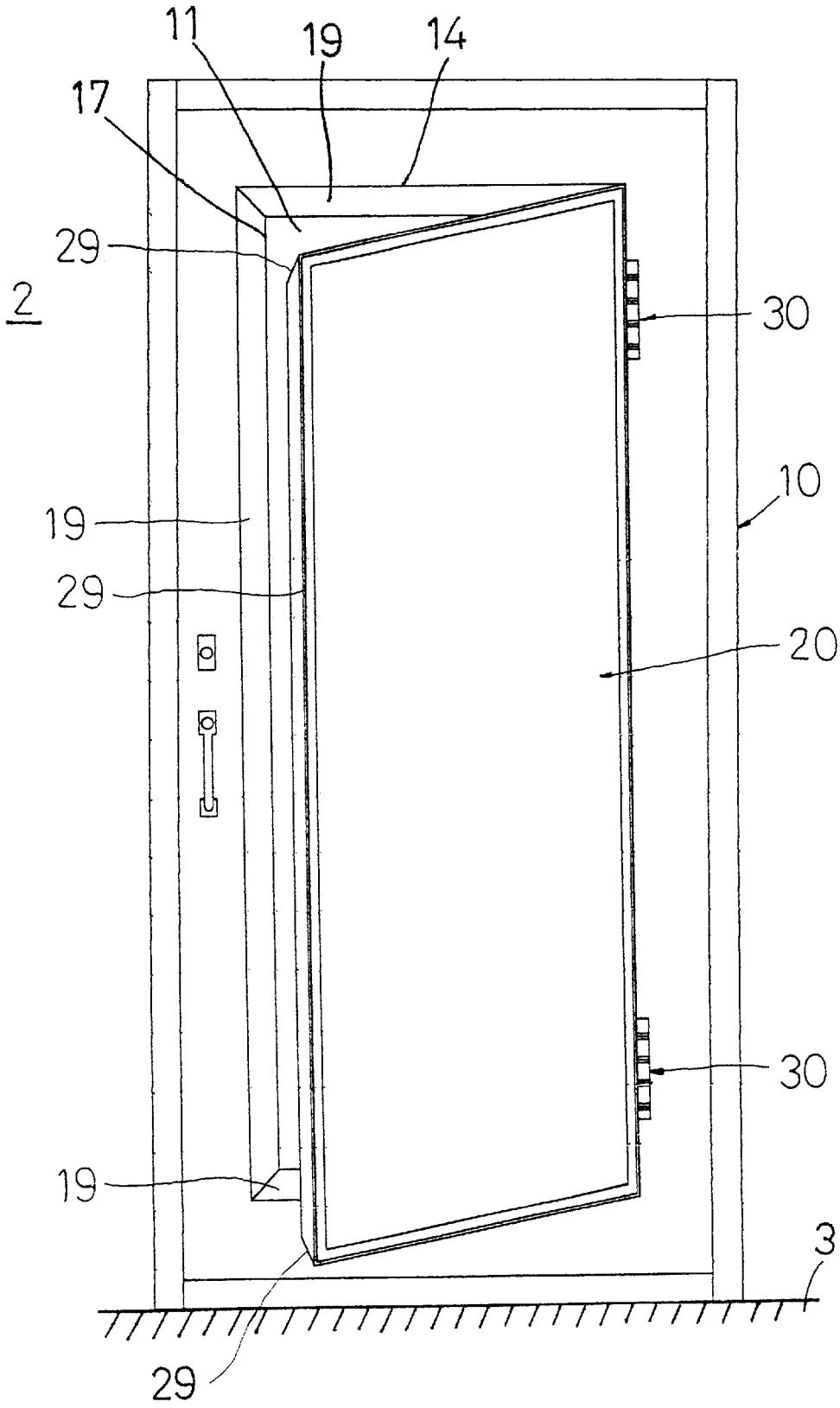
FIG. 1 is a perspective view of an emergency escape door assembly in accordance with the present invention, in which the auxiliary door panel is in an open status relative to the primary door panel.
Figure 2:
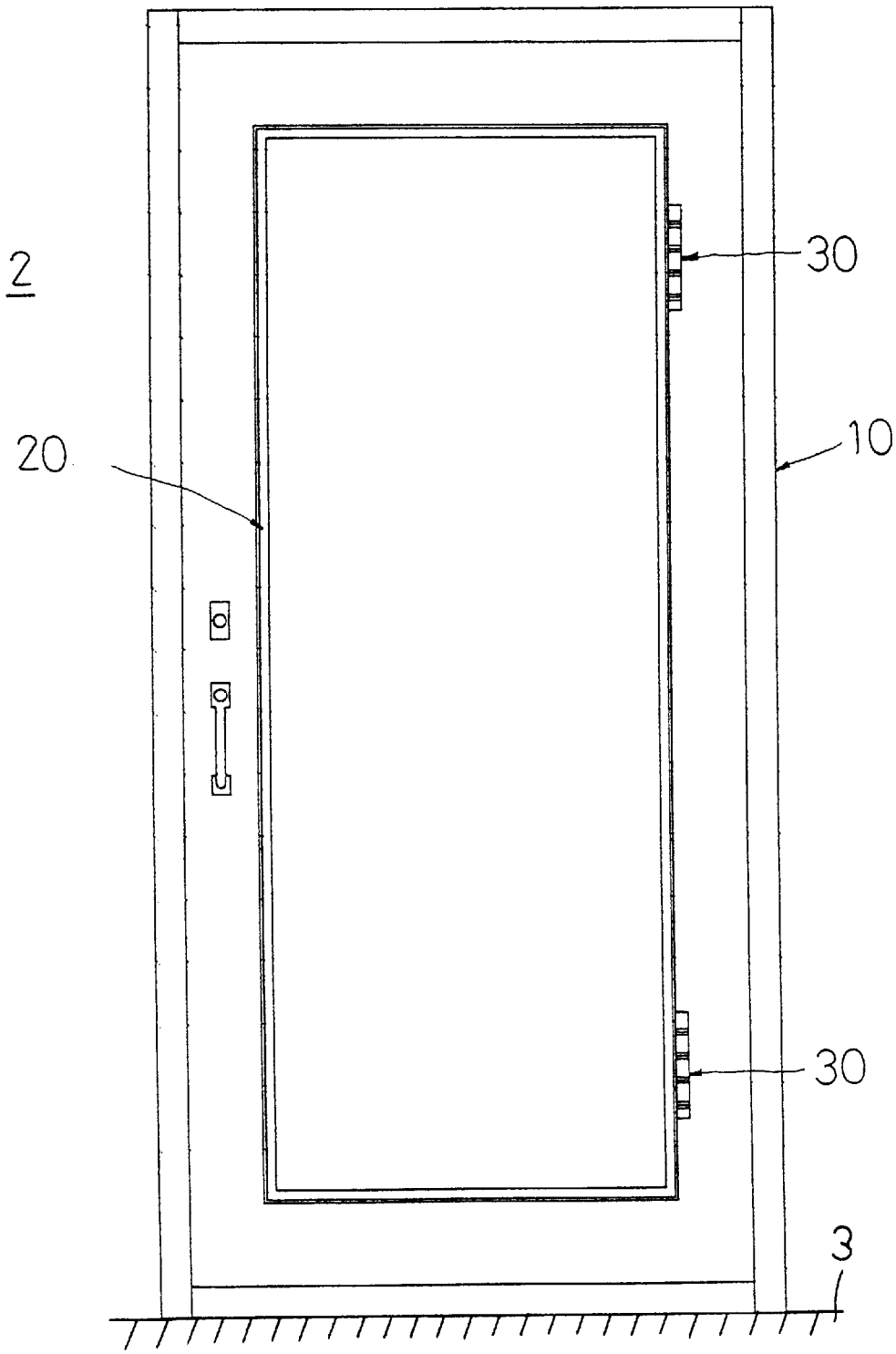
FIG. 2 is a plan schematic view of the emergency escape door assembly, in which the auxiliary door panel is in a closed status relative to the primary door panel.
Figure 3:
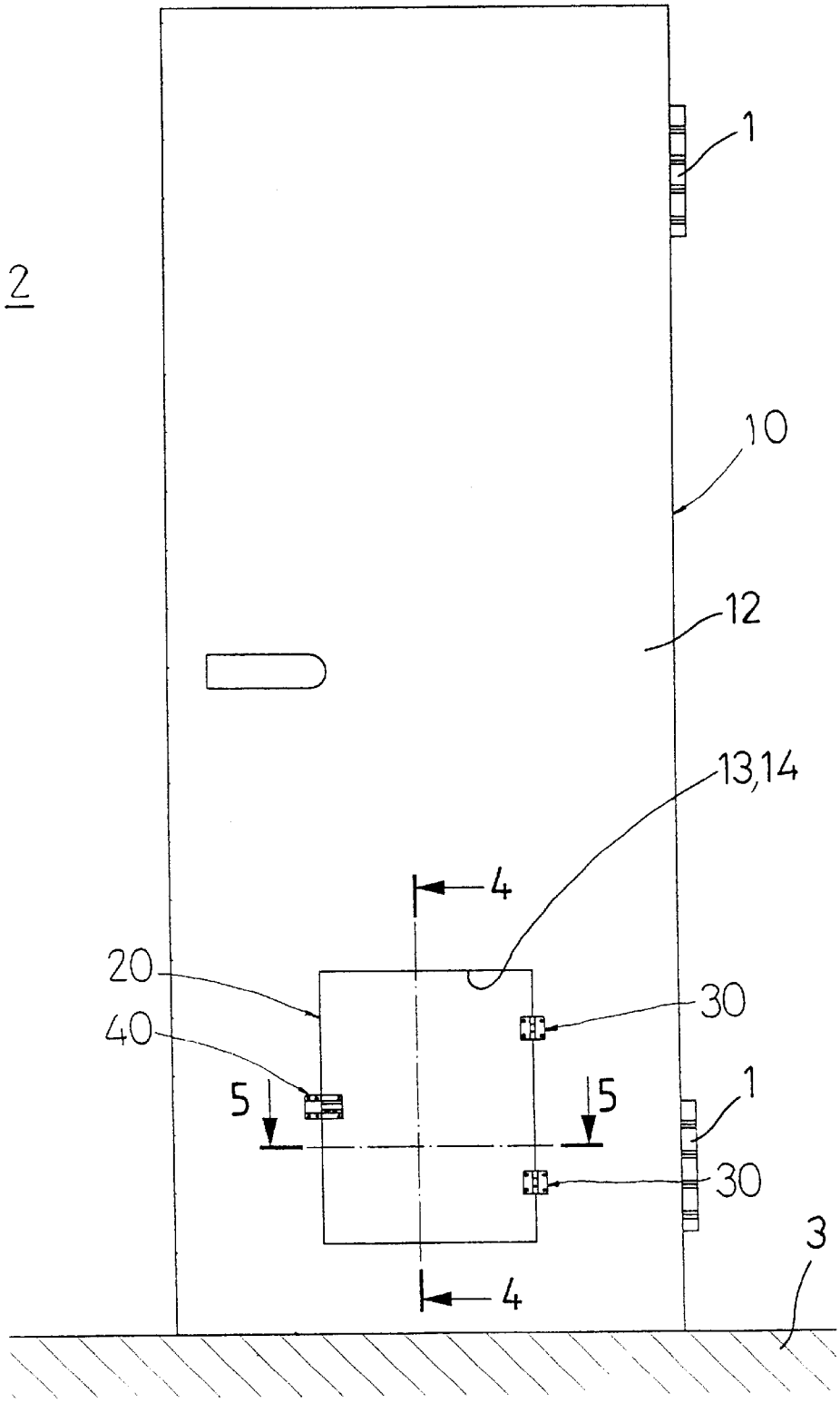
FIG. 3 is a plan schematic view of the emergency escape door assembly, similar to FIG. 2, illustrating a relatively smaller auxiliary door panel for the emergency escape door assembly.
Figure 12:
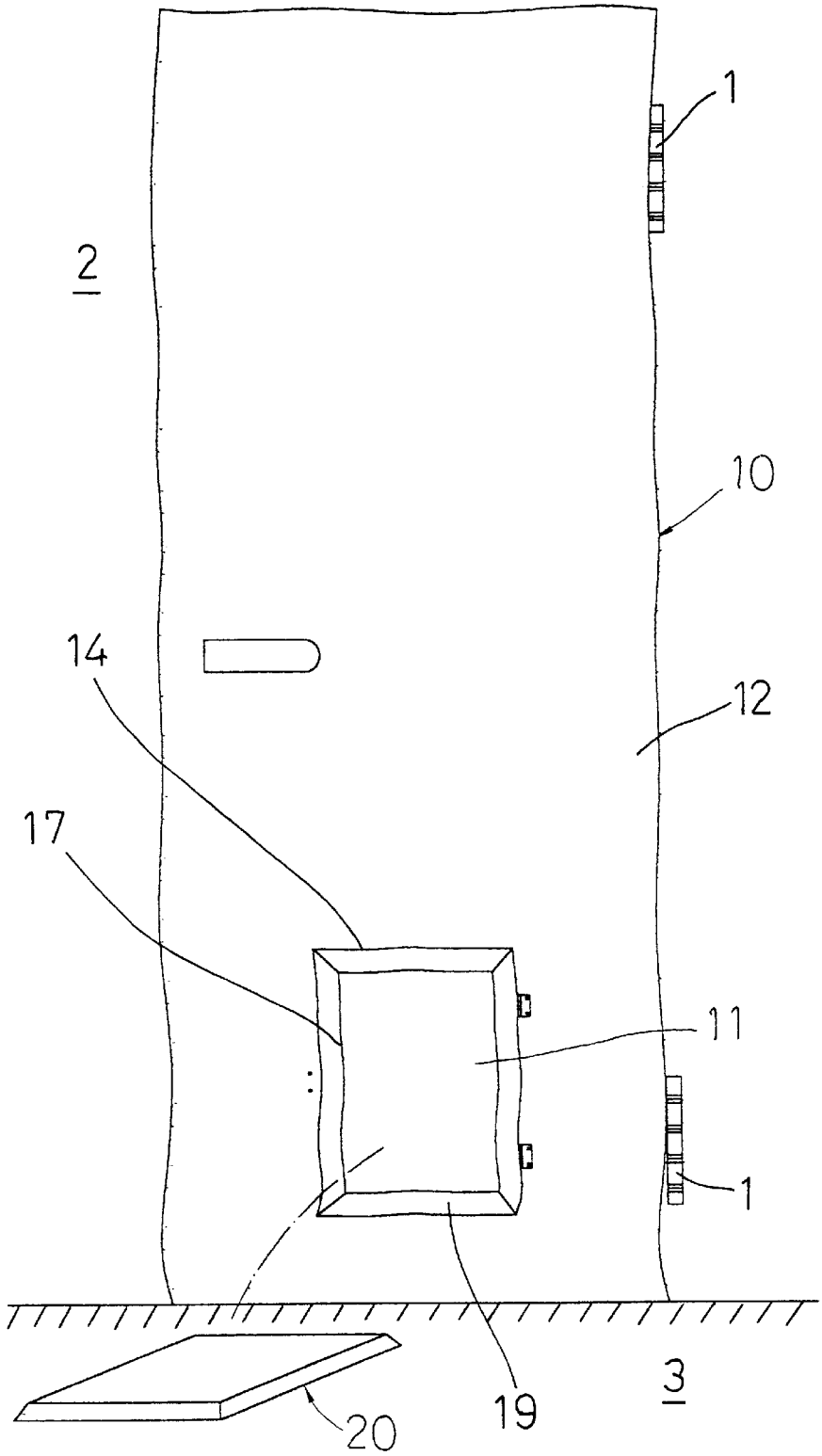
FIG. 12 is a plan schematic view illustrating the operation of the emergency escape door assembly.
Figure 13:
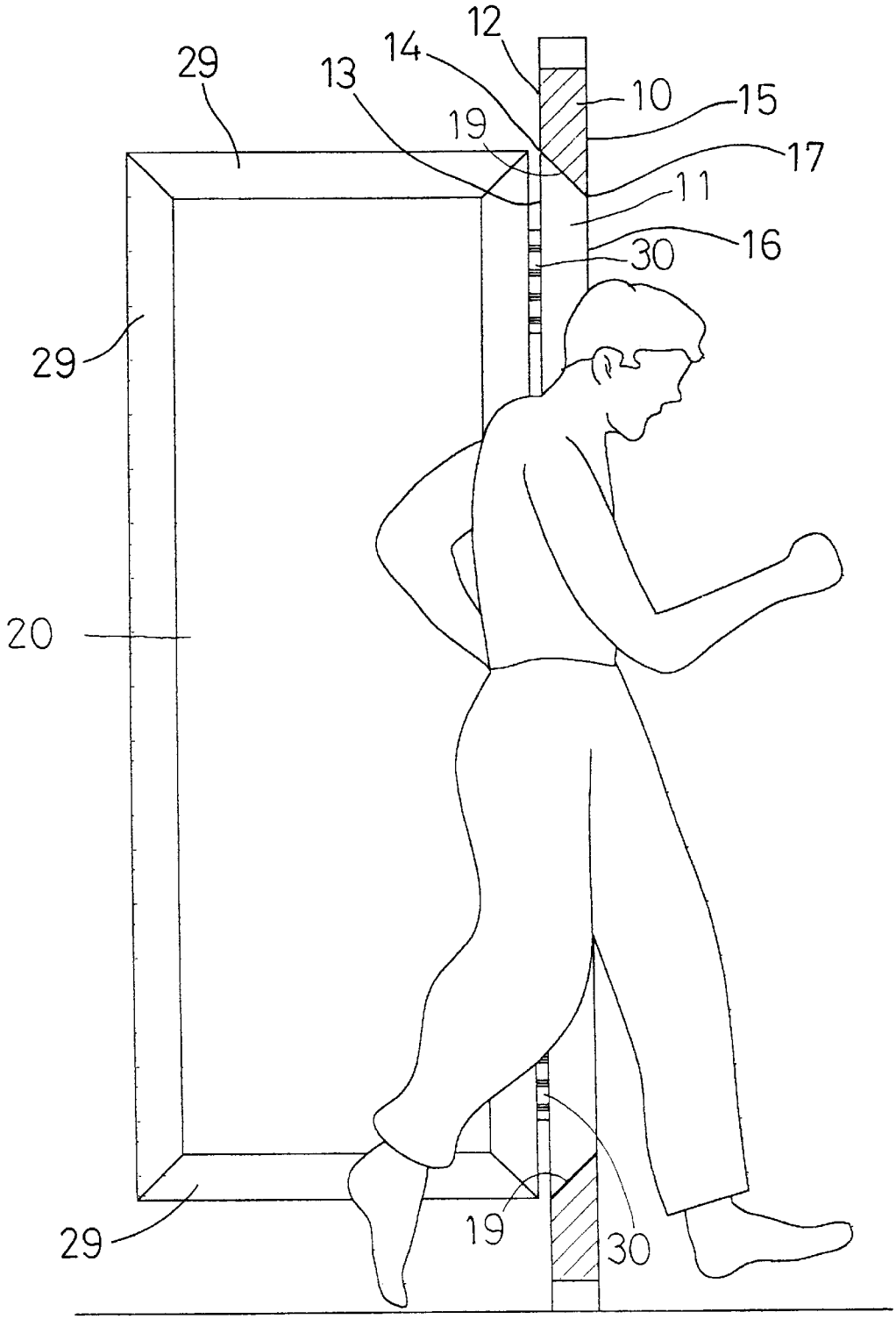
FIG. 13 is a partial cross sectional view illustrating the operation of the emergency escape door assembly.

Referring to the drawings, and initially to FIGS. 1–3, an emergency escape door assembly in accordance with the present invention comprises a primary door panel 10 to be pivotally attached to such as wall members 2 (FIGS. 3, 12) with pivot joints 1 and including an entrance 11 formed therein for forming or providing an emergency escape passage way (FIGS. 12, 13).

An auxiliary door panel 20 is pivotally attached to the primary door panel 10 with such as pivot joints 30, in order to openably enclose the entrance 11 of the primary door panel 10. A latch or a lock 40 (FIGS. 3, 4) may be attached to the primary door panel 10 and the auxiliary door panel 20, for selectively and openably locking the primary door panel 10 and the auxiliary door panel 20 together.

Figure 15:
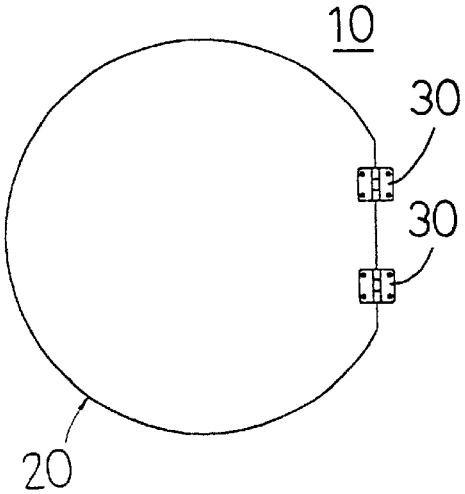
FIGS. 14, 15 are plan schematic views illustrating two further arrangement of the auxiliary door panels for the emergency escape door assembly.
Figure 14:
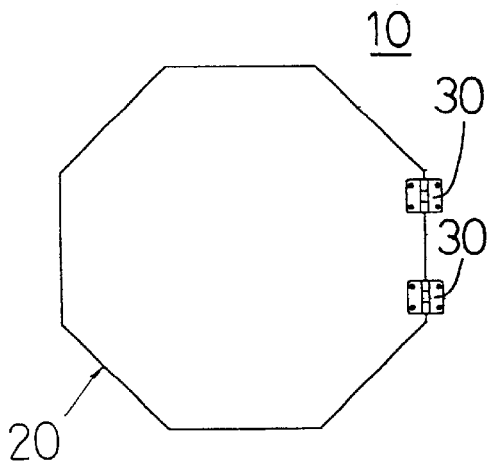

The entrance 11 of the primary door panel 10 and the auxiliary door panel 20 may be formed into different sizes or areas or widths or heights as shown in FIGS. 1–3, 12, 13, and may be formed into various shapes (FIGS. 12–14), such as the rectangular shape as shown in FIGS. 1–3, 12 and 13, the octangular shape (FIG. 14), or the circular shape (FIG. 15).

Figure 4:
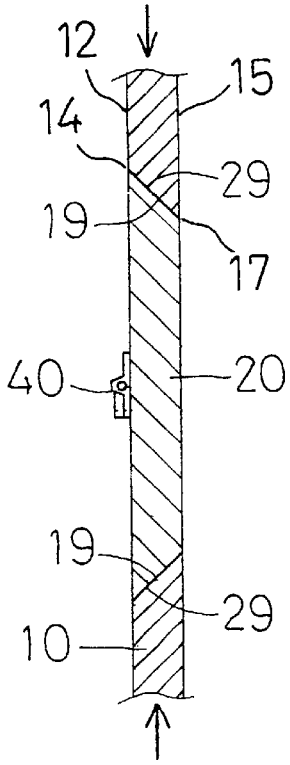
FIGS. 4, 5 are partial cross sectional views taken along lines 4—4 and 5—5 of FIG. 3 respectively.
Figure 5:
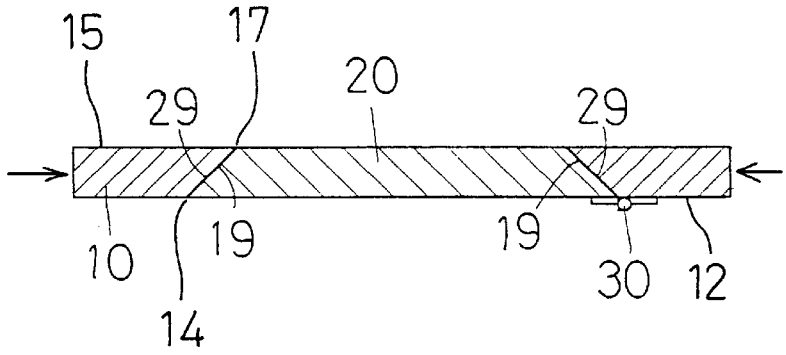

The primary door panel 10 includes an angled or inclined inner peripheral surface 19 formed therein for defining the entrance 11 thereof. The auxiliary door panel 20 includes an angled or inclined outer peripheral surface 29 formed therein for engaging or mating with the angled or inclined inner peripheral surface 19 of the primary door panel 10 (FIGS. 4, 5).

For example as shown in FIGS. 3–6, the primary door panel 10 includes one side, such as the inner side 12 having a greater opening 13 formed therein and defined by an inner peripheral contour 14, and the other side, such as the outer side 15 having a smaller opening 16 formed therein and defined by an inner peripheral contour 17.

As best shown in FIGS. 6 and 11–13, the angled or inclined inner peripheral surface 19 of the primary door panel 10 is angled or inclined from the smaller inner peripheral contour 17 of the outer side 15 toward the inner peripheral contour 14 of the inner side 12 thereof, and is opened outwardly, and is inclined in all of the peripheral portion thereof, including at least the side portions, the upper and the bottom portions thereof.

Figure 6:
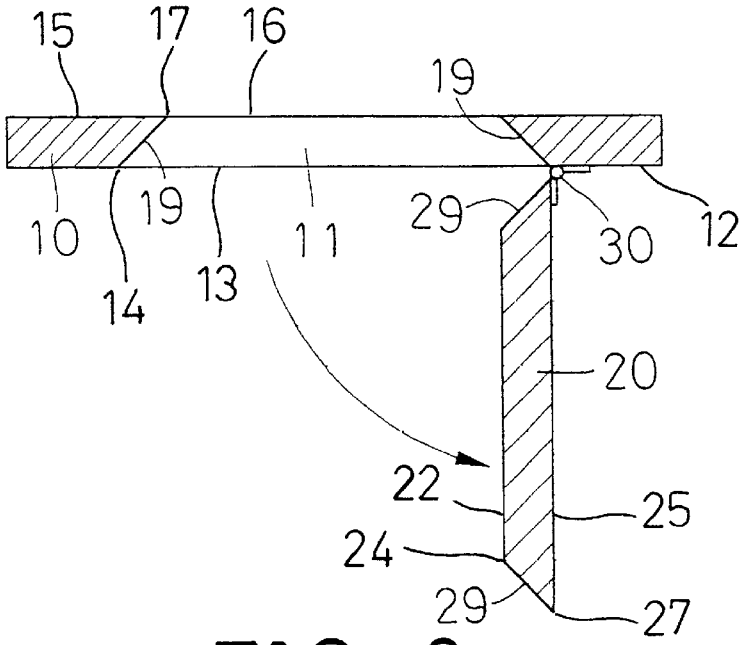
FIG. 6 is a partial cross sectional view similar to FIG. 5, illustrating the operation of the emergency escape door assembly.

Similarly, the auxiliary door panel 20 includes one side, such as the outer side 22 having a smaller outer peripheral contour 24, and the other side, such as the inner side 25 having a greater outer peripheral contour 27 provided therein, and the angled or inclined outer peripheral surface 29 of the auxiliary door panel 20 is angled or inclined from the smaller outer peripheral contour 24 of the outer side 22 toward the greater outer peripheral contour 27 of the inner side 25 thereof. As shown in FIG. 6, the auxiliary door panel 20 has the inner side 25 pivotally attached to the inner side 12 of the primary door panel 10 with the pivot joints 30, such that the auxiliary door panel 20 may be opened inwardly relative to the primary door panel 10.

Figure 7:
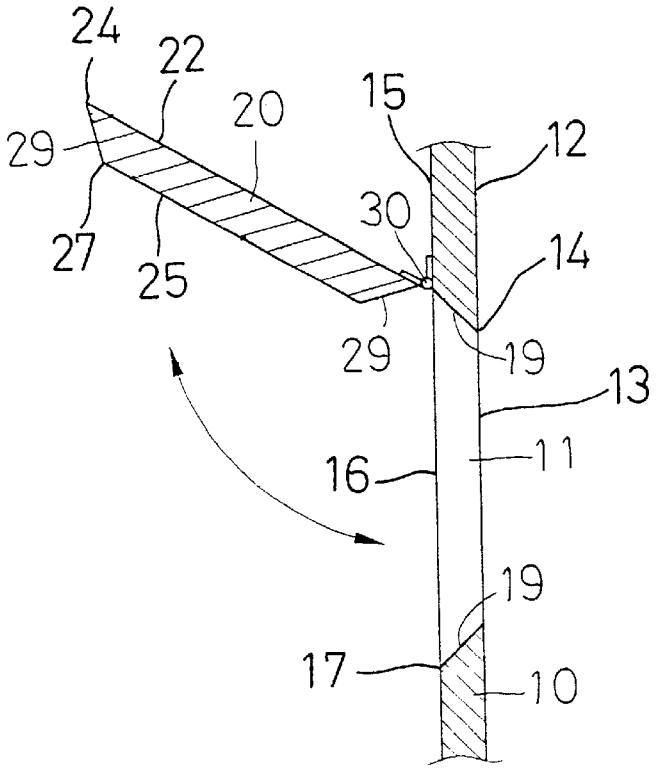
FIG. 7 is a partial cross sectional view similar to FIG. 6, illustrating the other arrangement of the emergency escape door assembly.

Alternatively, as shown in FIG. 7, the primary door panel 10 may include a smaller opening 13 and a smaller inner peripheral contour 14 formed in the inner side 12 thereof, and may include a greater opening 16 and a greater outer peripheral contour 17 formed in the outer side 15 thereof. The auxiliary door panel 20 may include a smaller outer peripheral contour 27 formed in the inner side 25 thereof, and may include a greater outer peripheral contour 24 formed in the outer side 22 thereof, and may has the outer side 22 pivotally attached to the outer side 15 of the primary door panel 10 with the pivot joints 30, such that the auxiliary door panel 20 may be opened outwardly relative to the primary door panel 10.

Figure 8:
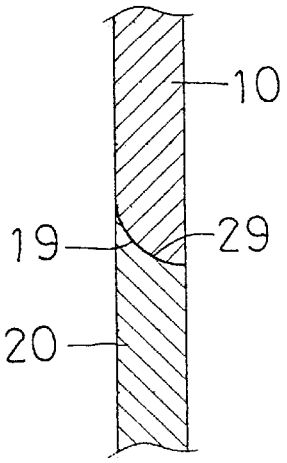
FIGS. 8, 9, 10 are partial cross sectional views similar to FIGS. 4, 5, illustrating the further arrangement of the emergency escape door assembly.
Figure 9:
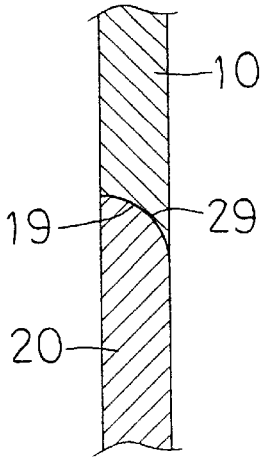
Figure 10:
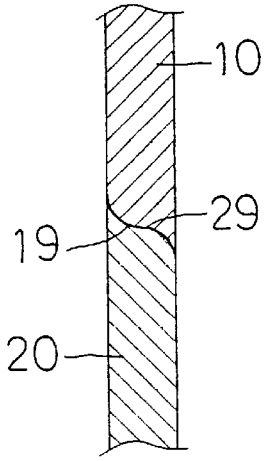
Figure 11:
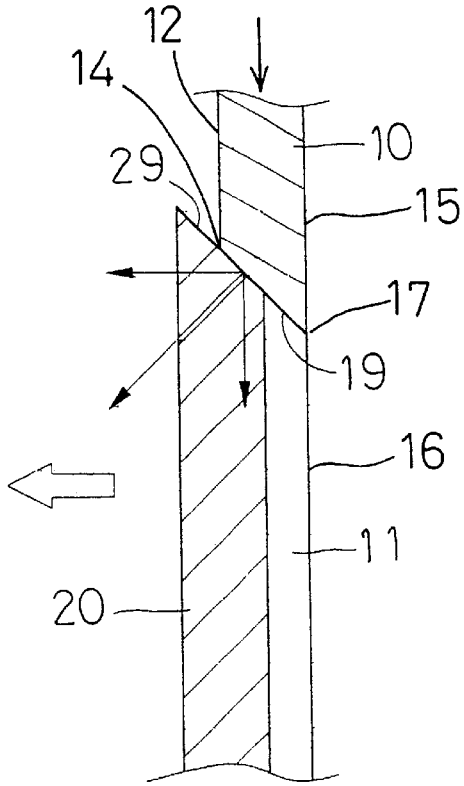
FIG. 11 is a partial cross sectional view similar to FIG. 4, illustrating the operation of the emergency escape door assembly.

Further alternatively, as shown in FIGS. 8–10, the angled or inclined outer peripheral surface 29 of the auxiliary door panel 20 may include a convex shape (FIG. 8) for engaging or mating with the concave angled or inclined inner peripheral surface 19 of the primary door panel 10; or may include a concave shape (FIG. 9) for engaging or mating with the convex angled or inclined inner peripheral surface 19 of the primary door panel 10; or may include a convex and a concave portions (FIG. 10) for engaging or mating with the concave and convex angled or inclined inner peripheral surface 19 of the primary door panel 10;

In operation, as shown in FIGS. 4, 5, 11, when an outer force is applied to either the upper and the lower sides of the primary door panel 10 (FIGS. 4, 11), and/or applied to either of the sides of the primary door panel 10 (FIG. 5), or when either side of said primary door panel is subjected with a compressing force, the auxiliary door panel 20 may be squeezed or forced out of or outwardly relative to the entrance 11 of the primary door panel 10, best shown in FIG. 11, by the sliding engagement between the angled or inclined outer peripheral surface 29 of the auxiliary door panel 20 and the angled or inclined inner peripheral surface 19 of the primary door panel 10, in order to break the pivot joints 30 and/or the lock 40, and thus for allowing the auxiliary door panel 20 to fall out of the primary door panel 10 (FIG. 12).

It is to be noted that the angled or inclined outer peripheral surface 29 of the auxiliary door panel 20 is formed in or around all the outer peripheral portion, of the auxiliary door panel 20, and the angled or inclined inner peripheral surface 19 of the primary door panel 10 is also formed on or around all the inner peripheral portion of the primary door panel 10, such that the auxiliary door panel 20 may be forced to fall out of the primary door panel 10 when the outer force is applied to either side or direction of the primary door panel 10, such that the users may safely move through the opening 11 of the primary door panel 10, particularly in such as an earthquake or a similar accident.

Accordingly, the emergency escape door assembly in accordance with the present invention includes an auxiliary door panel arranged to be automatically disengaged or separated from the primary door panel, in such as an earthquake or the other accidents.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An emergency escape door assembly comprising:

a primary door panel including an entrance formed therein, and including an inclined inner peripheral surface formed therein to define said entrance thereof said primary door panel including a first side having a greater opening formed therein and defined by a greater peripheral contour, and a second side having a smaller opening formed therein and defined by a smaller peripheral contour, said inclined inner peripheral surface of said primary door panel being inclined between said greater peripheral contour of said first side and said smaller peripheral contour of said second side thereof, and an auxiliary door panel pivotally secured to said primary door panel, and to selectively enclose said entrance of said primary door panel, said auxiliary door panel including an inclined outer peripheral surface formed therein for mating with said inclined inner peripheral surface of said primary door panel, and said auxiliary door panel including a first side having a greater outer peripheral contour, and a second side having a smaller outer peripheral contour provided therein, and said inclined outer peripheral surface of said auxiliary door panel being inclined between said smaller outer peripheral contour of said second side and said greater outer peripheral contour of said first side thereof, and said inclined outer peripheral surface of said auxiliary door panel being slidable relative to said inclined inner peripheral surface of said primary door panel to allow said auxiliary door panel to be automatically disengaged from said primary door panel when either side of said primary door panel is subjected with a compressing force.

2. The emergency escape door assembly according to claim 1, wherein said inclined outer peripheral surface of said auxiliary door panel includes a concave shape, and said inclined inner peripheral surface of said primary door panel is convex to mate with said concave and inclined outer peripheral surface of said auxiliary door panel.

3. The emergency escape door assembly according to claim 1, wherein said inclined outer peripheral surface of said auxiliary door panel includes a convex shape, and said inclined inner peripheral surface of said primary door panel is concave to mate with said convex and inclined outer peripheral surface of said auxiliary door panel.

4. The emergency escape door assembly according to claim 1, wherein said inclined outer peripheral surface of said auxiliary door panel includes at least one concave portion and at least one convex portion, and said inclined inner peripheral surface of said primary door panel includes at least one convex portion and at least one concave portion to mate with said at least one concave portion and said at least one convex portion of said inclined outer peripheral surface of said auxiliary door panel.

* * * * *